United States Patent [19]

Colonias et al.

[11] Patent Number: 4,995,206

[45] Date of Patent: Feb. 26, 1991

[54] ELEVATED POST BASE

[75] Inventors: Karen W. Colonias, Lafayette; Alfred D. Commins, Danville; Tyrell T. Gilb, Berkeley; Jin-Jie Lin, Livermore; Richard D. Moore, Newark, all of Calif.

[73] Assignee: Simpson Strong-Tie Company, Inc., San Leandro, Calif.

[21] Appl. No.: 550,961

[22] Filed: Jul. 11, 1990

[51] Int. Cl.[5] ..... E02D 27/00; E02D 27/42; E02D 27/44; E02D 27/50

[52] U.S. Cl. ..... 52/297; 52/298; 52/301; 52/712; 52/714; 52/715; 52/480

[58] Field of Search ..... 52/297, 298, 301, 480, 52/712, 713, 714

[56] References Cited

U.S. PATENT DOCUMENTS

| | | | |
|---|---|---|---|
| 4,096,677 | 6/1978 | Gilb | 52/297 |
| 4,543,757 | 10/1985 | Cosgrove | 52/297 |
| 4,644,713 | 2/1987 | Lehman | 52/298 |
| 4,924,648 | 5/1990 | Gilb et al. | 52/297 |

OTHER PUBLICATIONS

Simpson, Oct. 1969 catalog, p. 14.
Simpson, Oct. 1970 catalog, p. 20.
Simpson, Oct. 1971 catalog, p. 20.
Simpson, Jan. 1990 catalog, p. 14.
United Steel Products co., Jul. 1984 catalog, p. 22.
KC Metal Products, Inc., Jan. 1978 catalog, p. 29.
Harlen Metal Products, Inc., 1990 catalog, p. 21.

*Primary Examiner*—David A. Scherbel
*Assistant Examiner*—Manoj Samant
*Attorney, Agent, or Firm*—James R. Cypher

[57] ABSTRACT

A metal integral elevated post base for elevating the base of a wood post above a concrete base in which the post base is embedded. The post base includes a metal foot member embedded in the concrete base, a pair of metal post members integrally connected to the foot member partially embedded in and extending above the concrete base, and a pair of seat members integrally connected to the post members for supporting the wood post. Side members integrally connected to the seat members attach to the sides of the wood post. The post base is formed in two halves from a sheet metal blank and is configured as opposite halves and folded to form a single post and seat. Parts of the post base could be welded, but the preferred form is not welded.

10 Claims, 5 Drawing Sheets

ELEVATED POST BASE

BACKGROUND OF THE INVENTION

Elevated post bases consisting of a pipe and a U-bracket welded to the top of the pipe have been manufactured in the United States since at least as early as 1969. Since that time several manufacturers have manufactured and sold elevated post bases in large quantities to the construction industry.

The prior art elevated bases utilize expensive labor intensive manufacturing methods; welding requires that they be painted to protect from rust and corrosion and they are inherently not as strong as they might be due to the small welded area between the U-bracket and the pipe.

SUMMARY OF THE INVENTION

The gist of the present invention is the fact that it may be constructed from a single sheet metal blank, requires no welding or painting; and is inherently stronger in resisting rotational and bending moment forces imposed upon it through the wood post that it supports.

DESCRIPTION OF THE INVENTION

Figure 1:
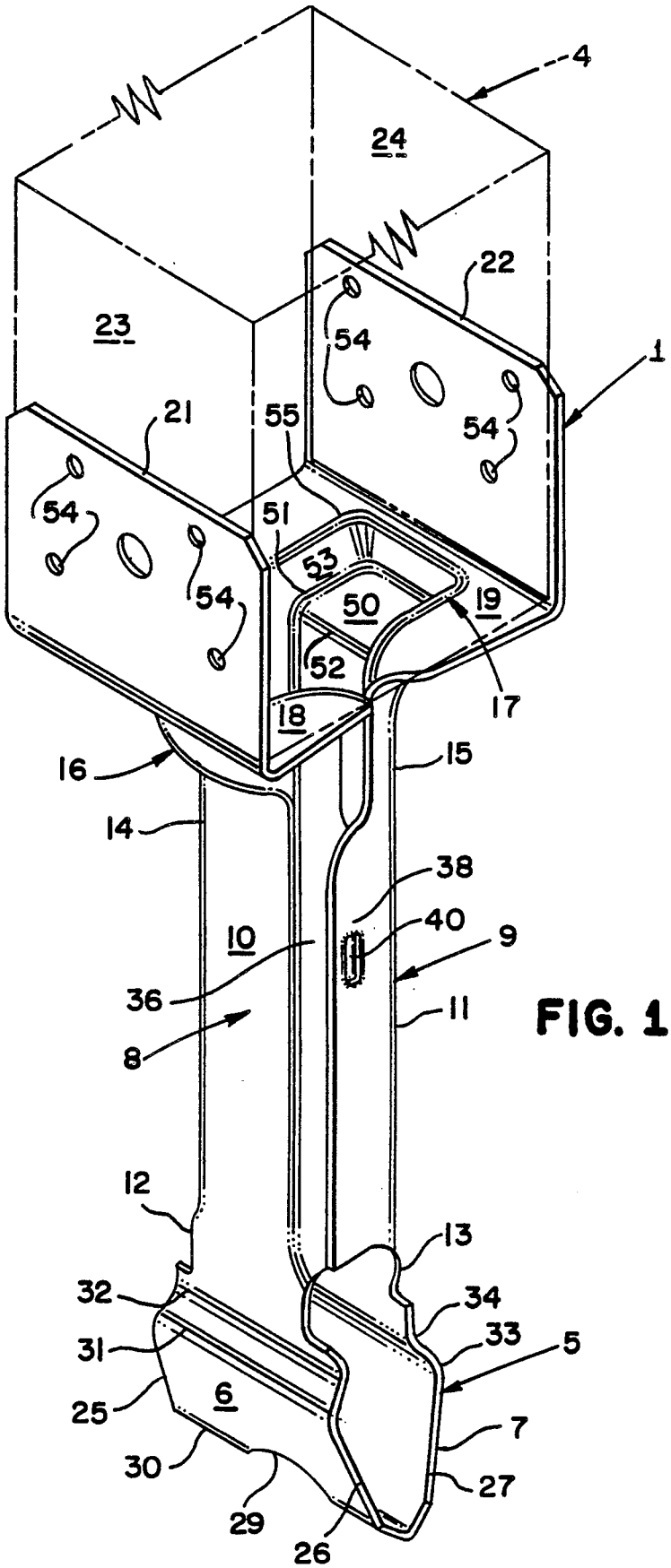
FIG. 1 is a perspective of the elevated post base with a wooden post illustrated in phantom line.
Figure 2:
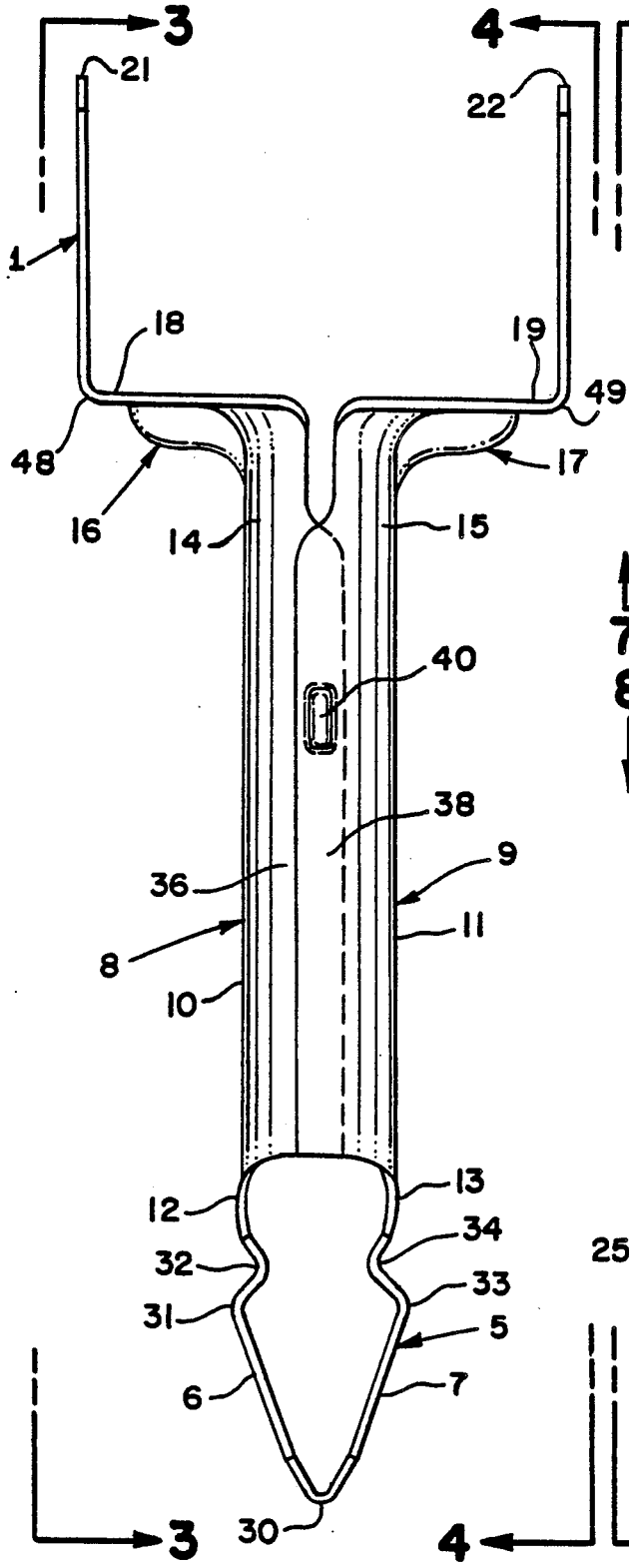
FIG. 2 is a side elevation view of the elevated post base of FIG. 1.

The metal integral elevated post base 1 of the present invention is formed from a sheet metal blank 2 embedded and supported by a concrete base 3 for supporting a wood post 4 and consists briefly of a metal foot member 5 having upstanding sides 6 and 7 adapted for embedment in the concrete base 3; a pair of metal post members 8 and 9 each having side members 10 and 11 and each having lower ends 12 and 13 individually and respectively integrally connected to the opposite sides of the foot member 5 and adapted for embedment in the concrete base 3, and having upper ends 14 and 15 extending above the concrete base 3; a pair of base members 16 and 17 integrally connected to the upper ends 14 and 15 of the post members 8 and 9 and extending upwardly and laterally away from the upper ends 14 and 15 of the post members 8 and 9; a pair of seat members 18 and 19 integrally connected to the base members 16 and 17 and forming a support for the end 20 of the wood post 4; and laterally disposed side members 21 and 22 integrally connected to and extending upwardly from the seat members 18 and 19 and adapted for attachment to at least two sides 23 and 24 of the post member 4.

The elevated post base 1 is preferably formed so that sides 6 and 7 of the foot member extend laterally beyond the sides 10 and 11 of the metal post members 8 and 9. In addition, the edges 25 and 26 of side 6 of foot 5 and edges 27 and 28 of side 7 of foot 5 may be formed so as to slant inwardly toward post members 8 and 9 thereby forming a wedge in combination with the concrete base 3 to better resist uplift. To permit easier installation of the elevated post base into wet concrete and to further interlock the elevated post base 1 with the concrete base 3, an opening 29 may be formed in foot member 5 at the intersection line 30 of sides 6 and 7. To stiffen the foot member for driving into wet concrete and to further enhance the ability of the elevated post base to resist withdrawal from the concrete base 3, nearly right angle bends are made in the sides of the foot member along bend lines 31, 32, 33, and 34.

Although embedment of the elevated post base 1 would hold the metal post members 8 and 9 together, preferably some means is provided to hold the two post members in place while the wet concrete cures. metal post member means holding the pair of metal post members in fixed relation to one another. The two post members could be welded together, but preferably some type of mechanical locking mechanism built into the post members is preferred.

To give rigidity and provide column strength, side flange means should be integrally attached to the respective metal post members throughout a substantial portion of their length and extend generally toward the other metal post member.

Preferably, the elevated post base 1 is constructed so that the side flange means consists of two pairs of flange members 35, 36, 37, and 38 with each pair of flange members respectively integrally attached to opposite sides of the metal post members 8 and 9. As shown in the drawings, greater column strength is achieved by dimensioning the flange members 35–38 so that they are contained one within the other. Thus as shown, for example on FIG. 7, flanges 35 and 36 interfit within and are overlapped by flanges 37 and 38. To maintain column strength throughout the length of the post, flanges 35–38 extend substantially from said foot member 5 to said base members 16 and 17.

One way to form a mechanical interlock between the post members 8 and 9 is to form deformed projection portions 39 and 40 in flanges 37 and 38. Depressions 41 and 42 are then formed in flanges 35 and 36. The deformed projection portion and the deformed depression portion are located in locking registration with one another. Post members 8 and 9 could also be held together by placing a pop rivet through openings in the post members 8 and 9.

To enable post member 4 to be easily attached, each of the laterally disposed side members 21 and 22 are formed with fastener openings 54.

The elevated post base of the present invention must meet several structural criteria not faced by standard post bases. Standard post bases rest upon the concrete and thus the concrete takes the compression load imposed by the post. Even commercial standoff post bases only raise the post about an inch above the concrete and thus it is easier to construct metal standoff bases. In contrast, the elevated post base of the present invention must support the base of the wood post 1' to 2½" above the concrete. This requires that the elevated post base have a column support which is strong, yet does not use an excess amount of metal. While a pipe is an ideal column, it requires that the pipe be attached to the base of the elevated post base by welding; as was the practice in the past.

Figure 7:
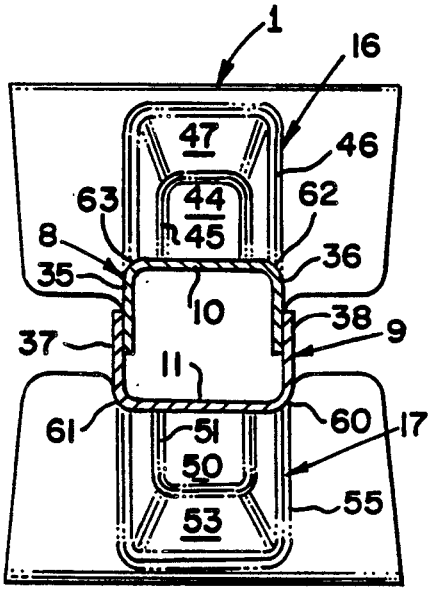
FIG. 7 is a cross sectional view of the elevated post base illustrated in FIG. 1 taken along line 7—7 of FIG. 3.
Figure 8:
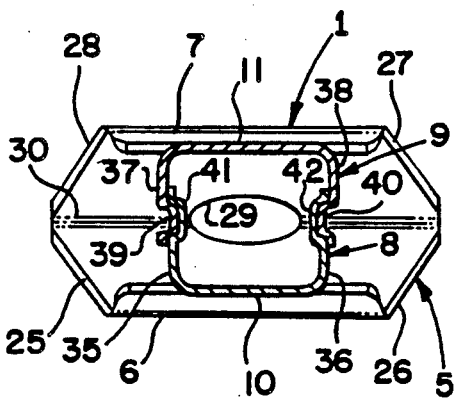
FIG. 8 is a cross sectional view of the elevated post base illustrated in FIG. 1 taken along line 8—8 of FIG. 3.
Figure 9:
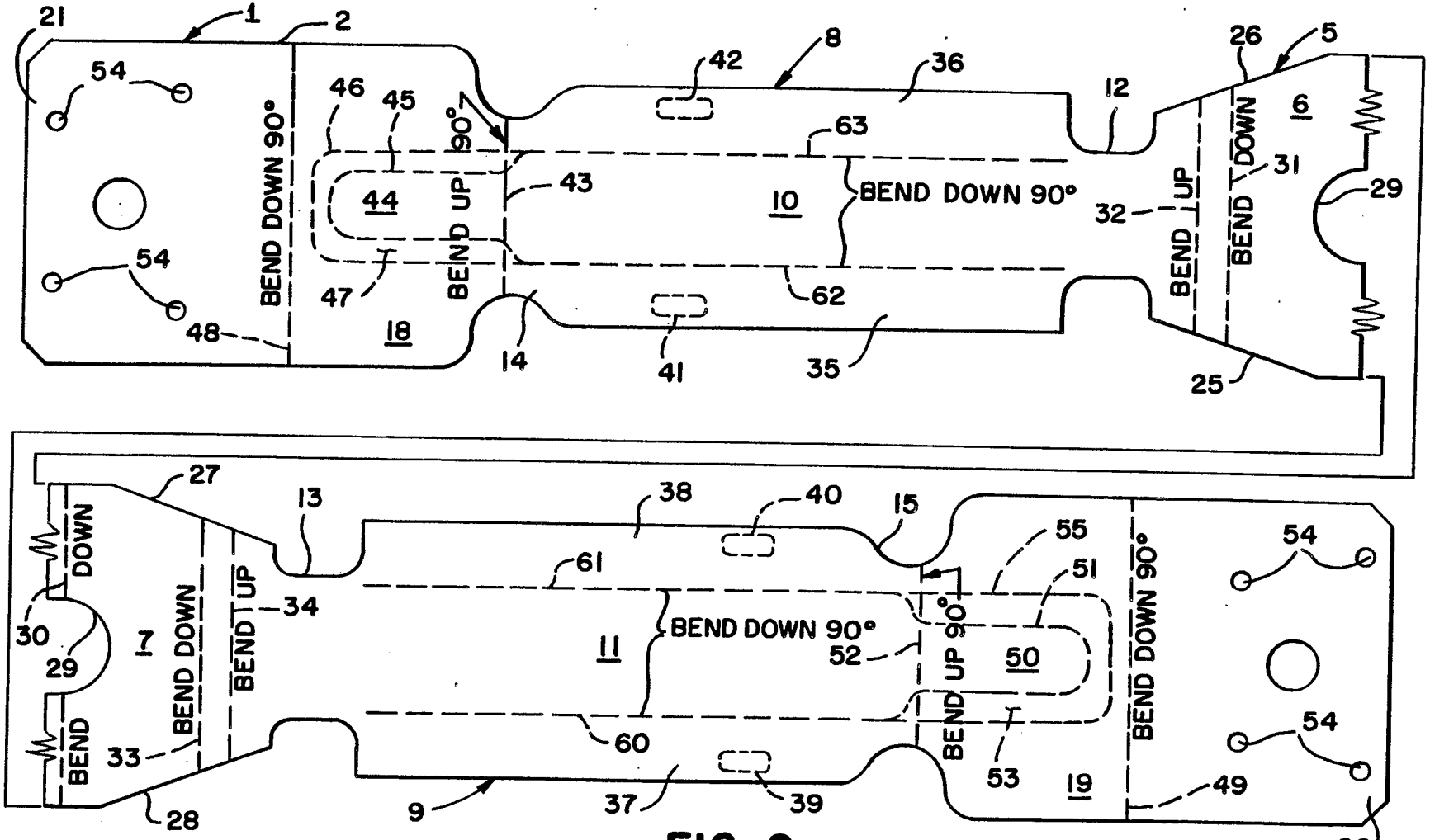
FIG. 9 is a plan view of the sheet metal blank used to form the elevated post base illustrated in FIG. 1. The sheet metal blank has been cut so that the entire blank may be shown on one sheet of the drawings.

The present invention replaces the tubular pipe with metal post members 8 and 9 formed in the shape of a "U" by bending the blank illustrated in FIG. 9 along bend lines 60–63, with the flanges 35–38 interfitting and overlapping as illustrated in FIG. 7. This is achieved by forming two sides of the connector from a blank and folding along a bend 30 so that the two sides come together much like a clam shell. Thus the two metal post members come together and form a tubular form structure which provides high column strength.

The second problem faced was the attachment of the metal post members 8 and 9 to the seat members 18 and 19 to receive the bottom of the post. As earlier stated, welding of the pipe member to the seat in the prior art was adequate, but a stronger joint was needed; particularly where bending moments were imposed by earthquake, high winds or even high water conditions. Instead of making a simple right angle bend between the post members 8 and 9, the solution lay in a complex bending arrangement illustrated in the drawings.

First, referring to the sheet metal blank illustrated in FIG. 9, a right angled bend is made at the upper end 14 of metal post member 8 along bend line 43. This 90° bend, however only affects base area 44 which remains generally at a right angle to side member 10. At boundry line 45 which forms a roughly "U" shape with the ends terminating at bend line 43, the base 16 slopes upwardly to join another U-shaped bend line 46 as shown in FIG. 7. The sloping drawn metal area between "U" shaped bend lines 45 and 46 forms in effect one half of a column capital area designated by the number 47 in FIGS. 7 and 9. The seat area 18 which is relatively horizontal to receive the bottom of wood post 4 is thus a "U" shaped area bounded by "U" shaped bend line 46 and side member bend line 48.

The column capital area 47 which forms a part of base member 16 is further strengthened to resist bending moments imposed by the wood post on metal post member 8 by the merging of column capital area 47 into flange members 37 and 38 by a smoothly curving compound curve. This is best seen in the description found below relating to the similar curvature relating to metal post member 9 illustrated in FIG. 1

The other half of column capital area 47 is repeated on the other side of the elevated post base blank 2 in FIG. 9 as follows: A right angled bend is made at the upper end 15 of metal post member 9 along bend line 52. This 90° bend, however only affects base area 50 which remains generally at a right angle to side member 11. At boundry line 51 which forms a roughly "U" shape with the ends terminating at bend line 52, the base 17 slopes upwardly to join another U-shaped bend line 55 as shown in FIG. 7. The sloping drawn metal area between "U" shaped bend lines 51 and 55 forms in effect the other half of a column capital area designated by the number 53 in FIGS. 1, 7 and 9. The seat area 19 which is relatively horizontal to receive the bottom of wood post 4 is thus a "U" shaped area bounded by "U" shaped bend line 52 and side member bend line 49.

The column capital area 53 forming part of base 17 is further strengthened to resist bending moments imposed by the wood post on metal post member 9 by the merging of column capital area 53 into flange members 37 and 38 by a smoothly curving compound curve. This is best seen in FIG. 1.

Figure 3:
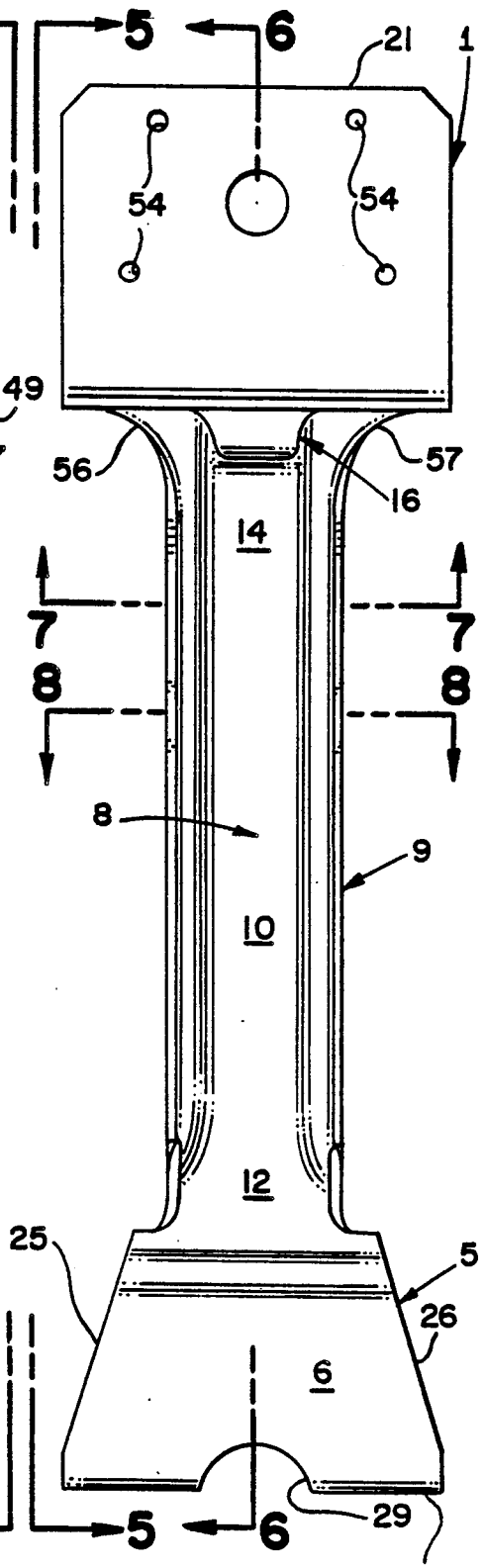
FIG. 3 is a side elevation view of the elevated post base illustrated in FIG. 2, taken in the direction of arrows 3—3 in FIG. 2.
Figure 4:
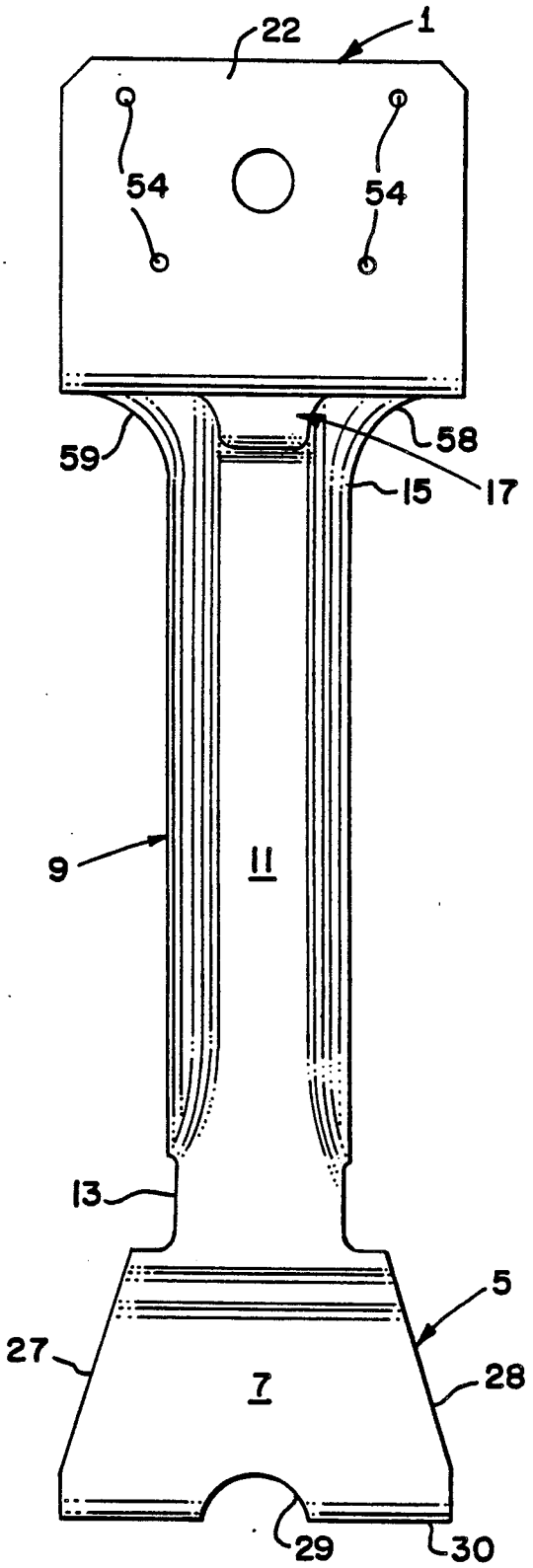
FIG. 4 is a side elevation view of the elevated post base illustrated in FIG. 2 taken along lines 4—4.
Figure 5:
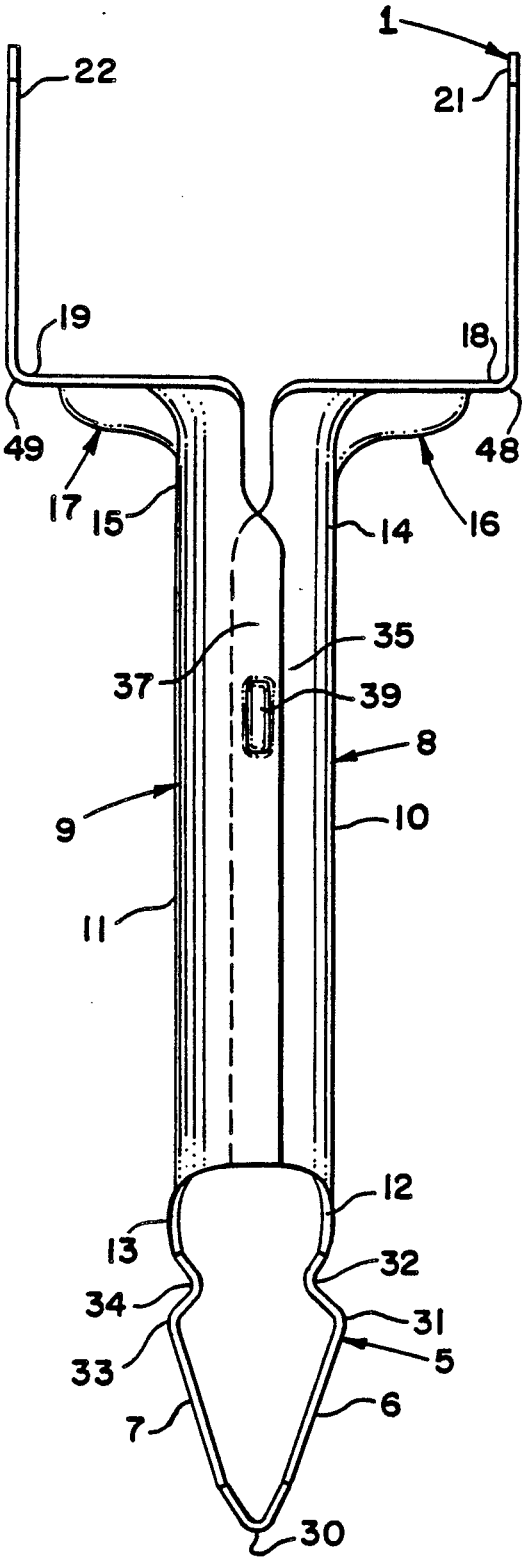
FIG. 5 is a side elevation view of the elevated post base illustrated in FIG. 3 taken along lines 5—5.
Figure 6:
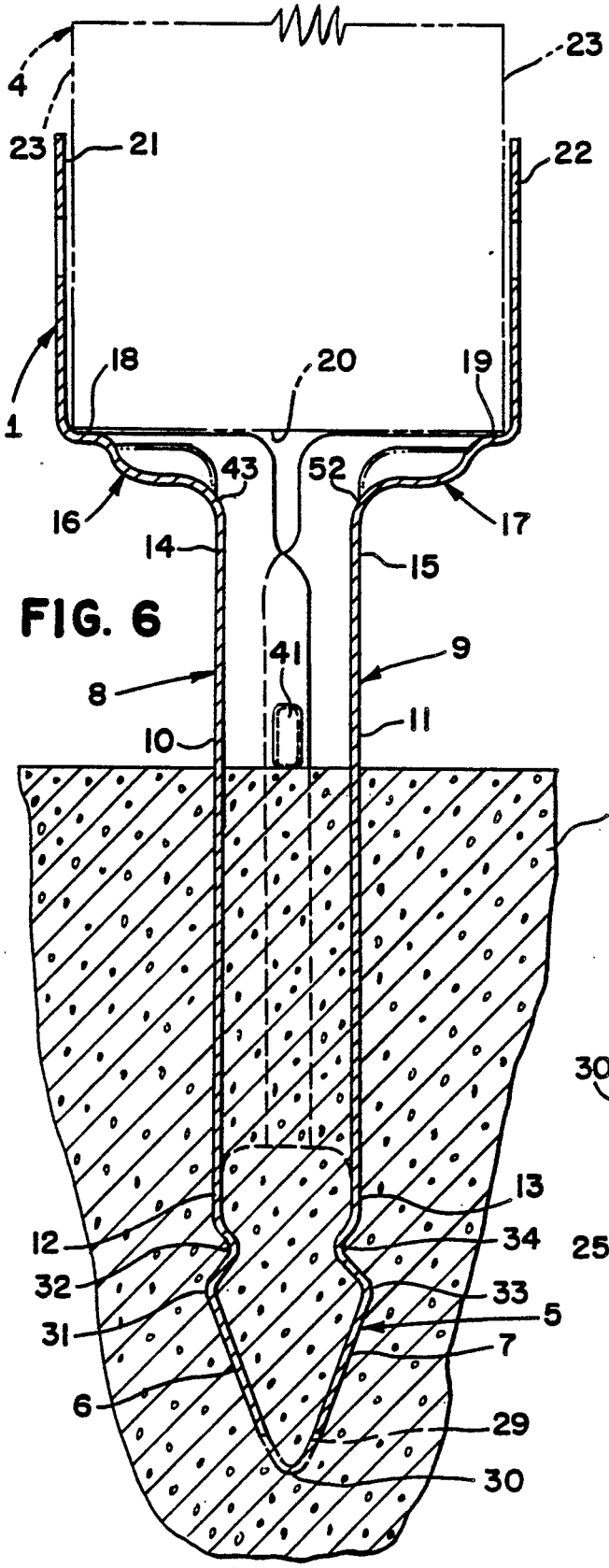
FIG. 6 is a cross sectional view of the elevated post base illustrated in FIG. 1 taken along line 6—6 of FIG. 3.

FIGS. 3 and 4 best illustrate another portion of the base members 16 and 17. As shown in the FIG. 3, upper portion 56 of flange 35 flares outwardly and upper portion 57 of flange 36 flares outwardly in the opposite direction. As shown in FIG. 4 upper portion 59 of flange 38 flares outwardly and upper portion 58 of flange 37 flares outwardly in the opposite direction. Flaring of the upper ends of the post flanges assists in strengthening the connection between the top of the metal post members 8 and 9 and the seat members 18 and 19.

In using the elevated post base of the present invention, the metal post members 8 and 9 may be either joined together at the factory or in the field. The elevated post base is installed by forcing it into wet concrete and a preselected location to a preselected elevation. After the concrete hardens, the post 4 is placed on seats 18 and 19 and nails driven through openings 54.

To insure filling of the inside of metal post members 8 and 9 with concrete to the final floor level, the elevated post member may be inserted into the wet concrete in the open position and then closed after the interior is filled with concrete. Vibrating the wet concrete around the elevated post base will insure that most all the voids in the elevated post base are filled with concrete.

We claim:

1. A metal integral elevated post base formed from a sheet metal blank embedded and supported by a concrete base for supporting a wood post comprising:

a. a metal foot member having upstanding sides adapted for embedment in said concrete base;

b. a pair of metal post members each having side members and each having lower ends individually and respectively integrally connected to said opposite sides of said foot member and adapted for embedment in said concrete base, and having upper ends extending above said concrete base;

c. a pair of base members integrally connected to said upper ends of said post members and extending upwardly and laterally away from said upper ends of said post members;

d. a pair of seat members integrally connected to said base members and forming a support for the end of said wood post; and e. laterally disposed side members integrally connected to and extending upwardly from said seat members and adapted for attachment to at least two sides of said post member.

2. An elevated post base as described in claim 1 wherein:

a. said sides of said foot member extend laterally beyond the sides of said metal post members.

3. An elevated post base as described in claim 1 wherein:

a. said metal foot member is formed with an opening therein.

4. An elevated post base as described in claim 1 comprising:

a. metal post member means holding said pair of metal post members in fixed relation to one another.

5. An elevated post base as described in claim 1 comprising:

a. side flange means integrally attached to said respective metal post members throughout a substantial portion of their length and extending generally toward the other of said metal post members.

6. An elevated post base as described in claim 5 wherein:

a. said side flange means consist of two pairs of flange members with each pair of flange members respectively integrally attached to opposite sides of said metal post members.

7. An elevated post base as described in claim 6 wherein:

a. said flange members extend respectively substantially from said foot member to said base members.

8. An elevated post base as described in claim 7 comprising:

a. a deformed projection portion formed in one of said flange members;

b. a deformed depression portion formed in one of said flange members overlaping said flange member formed with said deformed projection portion; and c. said deformed projection portion and said deformed depression portion are located in locking registration with one another.

9. An elevated post base as described in claim 6 wherein:

a. said side flange members of one of said metal post members overlap said side flange members from the other metal post member.

10. An elevated post base as described in claim 9 wherein:

a. each of said laterally disposed side members are formed with fastener openings.

* * * * *